US005849114A

United States Patent [19]

Keough et al.

[11] Patent Number: 5,849,114

[45] Date of Patent: Dec. 15, 1998

[54] METHOD OF FORMING PLATE-TYPE TRACK SHOE

[75] Inventors: John R. Keough, Bloomfield; Kathy L. Hayrynen, Northville, both of Mich.; John B. Wagner, Fond du lac, Wis.

[73] Assignee: Applied Process, Inc., Livonia, Mich.

[21] Appl. No.: 799,244

[22] Filed: Feb. 17, 1997

[51] Int. Cl.[6] ..... C21D 9/00

[52] U.S. Cl. ..... 148/548; 148/663

[58] Field of Search ..... 148/545, 548, 148/537, 540, 663

[56] References Cited

U.S. PATENT DOCUMENTS

| | | |
|---|---|---|
| 5,043,028 | 8/1991 | Kovacs et al. . |
| 5,064,478 | 11/1991 | Kovacs et al. . |
| 5,139,579 | 8/1992 | Kovacs et al. . |
| 5,246,510 | 9/1993 | Kovacs et al. . |
| 5,253,698 | 10/1993 | Keough et al. . |

OTHER PUBLICATIONS

Brochure entitled "Longer Wear Life, Better Performance and Dependability" by Intertractor dated Nov. 25, 1996.

*Primary Examiner*—Deborah Yee

*Attorney, Agent, or Firm*—Harness, Dickey & Pierce, PLC

[57] ABSTRACT

A method of manufacturing a plate-type track shoe. The method involves casting or obtaining a cast, plate-type track shoe which has been made from a suitably high quality ductile iron and heating the plate-type track shoe to a desired austentizing temperature within a range of about 1450° F.–1750° F. for up to about six hours to austentize the ductile iron. The plate-type track shoe is then rapidly cooled to a desired austempering temperature within a range of about 450° F.–800° F. and maintained at the desired austempering temperature for up to about 6 hours to isothermally produce a plate-type track shoe having an ausferrite microstructure. The plate-type track shoe is then cooled, washed, and optionally coated with a rust inhibitor and/or coated or painted. The process produces austempered plate-type track shoes which have high strength, excellent durability, and which are less costly to produce, per pound, than comparable parts manufactured from formed steel. Additionally, the cast feature allows surface features and indicia to be incorporated which is not possible with roll formed steel track plates. Most importantly, the process of the present invention enables specific, desired quantities of track shoes to be produced, which would not be possible with parts formed from steel, where an entire heat of rolled steel would have to be purchased and used, thus requiring the manufacture and inventorying of a very large quantity of track shoes.

11 Claims, 2 Drawing Sheets

FIG 1
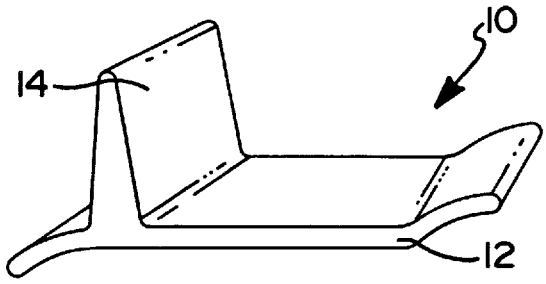
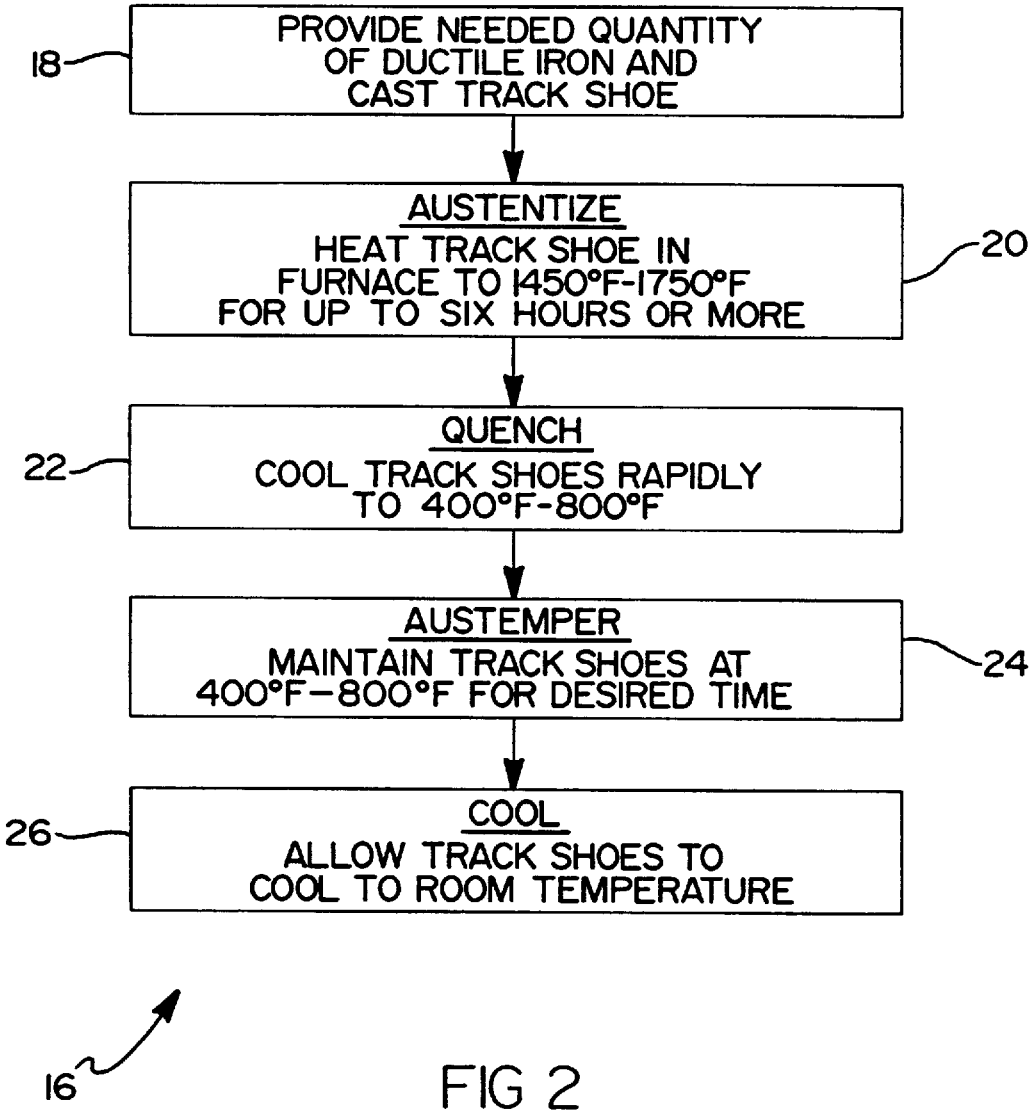
FIG 2

30
32
34
36
38
40
42
44
1800
1750
1350
900
675
450
0
TEMPERATURE
(IN DEGREES F)
0
3
6
9
12
TIME
(IN HOURS)

METHOD OF FORMING PLATE-TYPE TRACK SHOE

TECHNICAL FIELD

This invention relates to the manufacture of plate-type track shoes for tracked equipment, and more particularly to a method for cost effectively manufacturing desired quantities or lot sizes of plate-type track shoes suitable in strength and durability to permit use with various types of tracked equipment.

BACKGROUND OF THE INVENTION

Many forms of industrial vehicles and equipment make use of a number of platetype track shoes. Such vehicles include various forms of earth moving equipment and agricultural equipment, but are not limited to such equipment. Cranes and other forms of construction equipment also frequently incorporate such drive systems. Any type of vehicle or piece of equipment which incorporates a plate-type track shoe drive system is considered within the scope of the term "tracked equipment" as used herein.

The track shoes are secured to a form of endless drive belt made up of a plurality of interconnected links. The resulting endless drive belt is driven by one or more sprockets and a plurality of rollers to propel the vehicle or piece of equipment over dirt, soft sand and other like terrain which would be difficult or impossible to traverse with conventional tires. These plate-type track shoes are therefore subject to significant wear depending upon the frequency of use of the equipment associated therewith, the type of soil or surface driven over, and other factors. The track shoes used on these vehicles and equipment previously have been produced from rolled, formed or forged steel in the belief that formed steel was necessary to impart the required strength and wear resistance characteristics necessary for the track shoes, and therefore to avoid having to frequently replace track shoes which would become rapidly worn out or would likely break prematurely if manufactured from cast materials.

Forming plate-type track shoes from steel provides a number of disadvantages. For one, steel is relatively expensive compared to other materials. Manufacturing plate-type track shoes from steel often requires additional manufacturing steps such as shearing, punching and/or drilling that would not be required if the track shoes were produced from other materials such as cast iron. Most importantly, however, is that with steel, specific desired quantities of plate-type track shoes cannot be economically formed. This is because, in the industry, an entire "heat" of rolled steel (often from 20 tons to 80 tons or more) must be purchased at a time. In other words, a small subquantity of a heat cannot be purchased. If it is necessary to produce, for example, 20, 100 or 200 track shoes, in other words a specific, limited or desired quantity, there is no way a manufacturer could purchase only a portion of a heat of rolled steel sufficient to manufacture only the needed quantity. Thus, any manufacturer wishing to make a plate-type track shoe from steel must purchase a very large quantity of steel even though only a specific, desired quantity of track shoes may be needed.

The process of forming track shoes from steel also has a number of other costly drawbacks. For one, since the entire heat must be used, this results in the forming of a large quantity of parts which require significant storage space. The cost of maintaining a large inventory of track shoes serves to increase the overall cost of manufacture of the track shoes. Another drawback is the high cost of setting up the needed roll-forming die and associated equipment necessary to form track shoes from a heat of steel when only a specific, limited quantity of track shoes is needed which is less than the number which will be formed from the entire heat.

It is therefore a principal object of the present invention to provide a method for manufacturing a plate-type track shoe of high strength, durability and wear resistance in specific quantities as needed.

It is a further object of the present invention to provide a method for manufacturing plate-type track shoes from ductile iron to thereby permit desired, and often limited, quantities of plate-type track shoes to be quickly and cost effectively manufactured. More specifically, it is an object of the present invention to provide a method for producing a plate-type track shoe from ductile iron using an austempering process to produce a track shoe which is durable, light in weight as compared to a comparable formed steel track shoe, and which is capable of being manufactured in specific quantities, and often small quantities, as needed.

SUMMARY OF THE INVENTION

The above objects are met by a method for producing plate-type track shoes in accordance with a preferred embodiment of the present invention. The method of the present invention enables specific quantities of plate-type track shoes to be manufactured on an "as needed" basis.

The preferred method involves casting a desired quantity of plate-type track shoes from high quality ductile iron. The plate-type track shoes are then placed in a furnace and heated to a temperature in the range of about 1450° F.–1750° F. for a first length of time of up to about 6 hours or longer. After the expiration of this time period, the plate-type track shoes are cooled rapidly or "quenched" to a temperature in the range of about 450° F.–800° F. The plate-type track shoes are then maintained at this temperature range for a second time period to produce track shoes each having an ausferrite microstructure (that is, primarily consisting of acicular ferrite and high carbon austenite). The track shoes are then allowed to cool to an ambient temperature. Optionally, but preferably, the track shoes are then washed and/or coated with a rust inhibitor. The track shoes are then ready for painting, coating with any other material, or immediate use.

Each resulting plate-type track shoe is lighter in weight and less costly (per pound of material used) to manufacture than if same was formed from steel. The austempering process provides a plate-type track shoe which has an ausferrite microstructure and which is therefore very strong, durable and highly resistant to wear. Most importantly, the track shoes can be manufactured in specific, desired quantities which would otherwise not be possible if same were formed from steel. In the latter instance, the manufacturer would be required to purchase an entire heat of steel and to run off a quantity of parts in number sufficient to use the entire heat. With the method of the present invention, specific quantities of austempered track shoes can be economically manufactured as needed.

BRIEF DESCRIPTION OF DRAWINGS

The various advantages of the present invention will become apparent to one skilled in the art by reading the following specification and subjoined claims and by referencing the following drawings in which:

FIG. 1 is a view of plate-type track shoe manufactured in accordance with the preferred methods of the present invention;

FIG. 2 is a flow chart outlining the major steps of the method of the present invention.

DETAILED DESCRIPTION OF THE PREFERRED EMBODIMENTS

Figure 3:
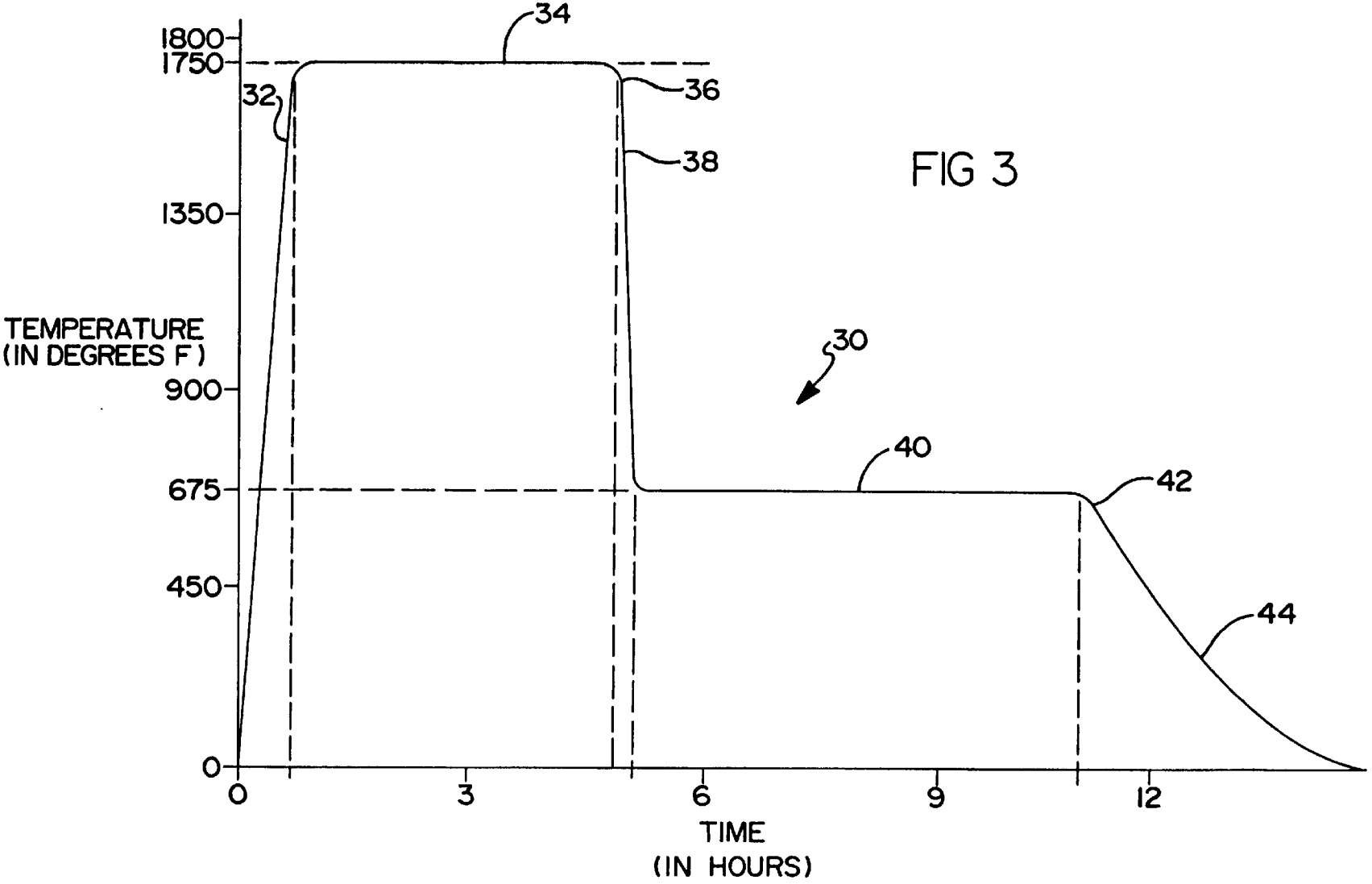
FIG. 3 is an exemplary temperature vs. time graph illustrating the various steps of the method of the present invention.

Referring to FIG. 1, there is shown an exemplary grouser, plate-type track shoe 10 suitable for use with tracked equipment. It will be appreciated immediately, however, that the track plates manufactured in accordance with the preferred method of the present invention are suitable for use with virtually any tracked type vehicles and equipment. A track plate 10 generally includes a base portion 12 and a rib (or ribs) 14 integrally formed therewith. It will be appreciated that the height of the rib 14, as well as the length and width of the base portion 12 can vary widely depending upon the specific type of equipment being used and other requirements. The overall shape can also vary considerably depending on the specific type of equipment the track shoes will be used with and the surface on which the equipment is used. The casting method also allows for surface features unavailable with rolled steel plate-type track plates, (such as dimples, zig zag patterns and even company logos).

Heretofore such plate-type track shoes have been formed from steel which has required the purchase of large quantities of steel. In the industry, a manufacturer must purchase an entire "heat" (often 20 tons to 80 tons or more) of rolled steel. It is presently often difficult or impossible to purchase smaller quantities of rolled steel. In forming plate-type track shoes from steel, a special roll die must be set up and maintained and the entire heat must be used to produce the track shoes. Thus, a manufacturer wishing to produce track shoes must produce usually 20–80 tons or more of track shoes. Accordingly, it is not possible, when forming track shoes from steel, to manufacture just 20, 100 or 200 track shoes or some other specific quantity which is less in number than that which would be formed from an entire heat of steel. Rather, a very large quantity must be manufactured at one time.

Referring now to FIG. 2, a flow chart 16 in accordance with the principal steps of the preferred method of the present invention is shown. In summary, the preferred method involves casting a specific, desired quantity of plate-type track shoes from a suitably high quality ductile iron. The casting process permits a desired quantity of track shoes to be manufactured. Thus, if an equipment producer only needs, for example, 100 track shoes, this quantity can be quickly and easily cast. The cast track shoes are then subjected to an austempering process to produce track shoes each having an ausferrite microstructure. The preferred method produces track shoes which are generally lighter in weight, cost less per pound to manufacture, and generally require fewer manufacturing steps than that required to form comparable plate-type track shoes from steel.

With specific reference to FIG. 2, a specific quantity of suitably high quality ductile iron is initially provided, as indicated at step 18, and the plate-type track shoe 10 is cast therefrom using a casting pattern in the form of the desired track shoe. The cast track shoes are then heated, such as in a furnace, to an austentizing temperature in the range preferably of about 1450° F.–1750° F. The track shoes are maintained at the selected austentizing temperature for a first time period in the range of between zero hours up to about six hours or more, as indicated at step 20, which comprises the austentizing step. This austentizes the ductile iron and saturates the metal matrix of the ductile iron with the equilibrium level of carbon. After this time period has expired, the track shoes are cooled rapidly to a temperature in the range of about 450° F.–800° F., as indicated at step 22. The cooling, in the preferred method, is accomplished by "quenching" (i.e., submerging) the track shoes into a molten salt bath maintained at the selected austempering temperature (i.e., in the range of about 450° F.–800° F.) to quickly (i.e., within seconds or minutes) reduce the temperature of the track shoes to the selected austempering temperature. Accordingly, step 22 generally comprises the quenching step. It will be appreciated that the quenching could be performed in various other ways besides a molten salt bath. For example, the track shoes could be quenched in lead, in a high pressure gas environment or through any other means or step which serves to very quickly reduce the temperature of the track shoes to the desired austempering temperature. Regardless of how quenching is performed, it is important that the plate-type track shoe be cooled quickly enough to avoid the formation of undesirable high temperature transformation products.

The plate-type track shoe is maintained at the selected austempering temperature for a second time period preferably between about zero hours and six hours to isothermally produce an ausferrite microstructure with specific desired properties as indicated at step 24. This is generally viewed as the austempering step. It will be appreciated that if a part having a high hardness is desired, then a specific austempering temperature toward the lower end of the 450° F.–800° F. range will need to be used. If a part having a lower hardness is desired, then the austempering temperature selected will need to be toward the upper end of the 450° F.–800° F. range.

It will also be appreciated multiple austempering temperatures could be used to produce track shoes having specific properties and characteristics. For example, the track shoes 10 could be quenched to a first austempering temperature of, say, 500° F. for a first time interval of maybe 30 minutes, and then immediately elevated to a second austempering temperature of maybe 700° F. for a second time interval of four hours. This example is meant to illustrate that a wide variety of variations of the basic steps of the preferred method shown in FIG. 2 are possible and are within the intended scope of the appended claims.

With further reference to FIG. 2, the plate-type track shoe is then removed from the molten salt bath and allowed to cool to room temperature (i.e., ambient temperature), as indicated at step 26. Optionally, but preferably, the plate-type track shoe is then washed with water. At this point the track shoe may also be coated with some form of conventional rust inhibitor or otherwise treated, coated or painted, as specifically requested by a customer. The parts are then ready for use.

With brief reference to FIG. 3, an exemplary graph 30 is shown which also illustrates the above-described steps. Portion 32 illustrates the cast track shoe being heated rapidly to the austentizing temperature of, in this example, 1750° F. Portion 34 indicates the track shoe being held at the austentizing temperature for a time period of, in this example, about 4.5 hours. At point 36 the track shoe is quenched and cools rapidly, as indicated by slope 38, to the austempering temperature, in this example about 675° F. The track shoe is held at this austempering temperature for, in this example, about 6 hours, as indicated by portion 40. At point 42 the track shoe is removed from the molten salt bath and cools to room temperature, as indicated by slope 44.

It will be appreciated that the above-described steps can be performed with a single track shoe or a number of track shoes, but that in most cases a desired plurality of track shoes are processed at one time with the above-described method. Furthermore, it will be appreciated that step 18 is common to the manufacture of any type of plate-type track shoe cast from ductile iron. The initial casting of the plate-type track shoes and the austempering process described herein can take place in one facility if needed, but these processes can also be carried out in separate facilities.

The above-described method provides a number of important advantages over forming comparable parts with steel. For one, and perhaps most importantly, specific quantities of a desired part, where the part is required to have excellent strength and durability characteristics, can be easily manufactured. The plate-type track shoe shown in FIG. 1, if it were to be manufactured from steel, would have to be made in a very large quantity (typically 20–80 tons worth of parts) if it is formed from steel. Forming the plate-type track shoe 10 from steel would also result in a higher cost-per-pound of material used than the cost of manufacturing from ductile iron and treating with the austempering process described herein. Casting the plate-type track shoe 10 from ductile iron also simplifies or eliminates the machining process and requires fewer machining steps and produces less wasted material than would otherwise be occasioned if the track shoe 10 was formed from steel. The resulting track shoe 10 is therefore less costly to produce, has excellent strength and durability characteristics, requires fewer machining steps to produce the final product and can be made in very specific or limited quantities. The plate-type track shoe 10, being made in accordance with the preferred method described herein, generally weighs about 10% less compared with a similar product formed from steel. The cost reduction can be about 25% per pound over a comparable product formed from steel.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method of producing through-hardened, high strength, austempered lightweight track shoes for tracked equipment and vehicles to permit specific quantities of said track shoes to be produced cost effectively, said method comprising the steps of:

providing a casting pattern in the form of a track shoe;

providing a quantity of ductile iron sufficient to produce therefrom a desired limited quantity of said track shoes;

casting said track shoe in said casting pattern from a small sub-quantity of said ductile iron;

allowing said track shoe to solidify in said casting mold;

removing said track shoe from said casting mold;

heating said track shoe to an austentizing temperature in the range of about 1450° F.–1750° F. for a first length of time of greater than 0 hours and no greater than about 6 hours;

cooling said track shoe rapidly after expiration of said first length of time to an austempering temperature in the range of about 450° F.–800° F.;

maintaining said track shoe at a temperature within said temperature range of about 450° F.–800° F. for a second time period greater than 0 hours and no more than about 6 hours to produce an austempered track shoe having an ausferrite microstructure and being hardened completely through the entire cross section of said track shoe;

cooling the track shoe to an ambient temperature; and repeating the above steps until said desired quantity of track shoes has been produced.

2. The method of claim 1, wherein said step of cooling said track shoe rapidly after expiration of said first length of time comprises quenching said track shoe in a molten salt bath maintained at a temperature within said 450° F.–800° F. range.

3. The method of claim 1, further comprising the step of coating said track shoe with a first coating after said track shoe has cooled to said ambient temperature.

4. The method of claim 3, wherein the step of coating the track shoe with a first coating comprises applying a coating of a rust inhibitor on said track shoe.

5. The method of claim 3, wherein the step of coating said track shoe with a first coating comprises painting said track shoe.

6. A method of producing through-hardened, high strength, lightweight track shoes for tracked equipment in a manner conducive to manufacturing desired quantities of said track shoes, which said desired quantities are smaller than the number of said track shoes that would need to be produced from a heat of steel, said method comprising the steps of:

a) providing a track shoe cast from ductile iron;

b) heating said track shoe to an austentizing temperature in the range of about 1450° F.–1750° F. for a first length of time of up to about six hours;

c) causing said track shoe to cool rapidly after said first length of time has expired to an austempering temperature in the range of about 450° F.–800° F.;

d) maintaining said shoe at said austempering temperature within said range of about450° F.–800° F. for a second length of time of greater than 0 hours and no greater than about 6 hours to isothermally treat said track shoe to produce an ausferrite microstructure and to harden said track shoe through the entire cross section thereof; and e) allowing said track shoe to cool to an ambient temperature.

7. The method of claim 6, wherein step d) comprises the step of quenching said track shoe in a substance maintained at a temperature within said 450° F.–800° F. range.

8. The method of claim 6, further comprising the step of washing the track shoe with water after said track shoe has cooled to approximately room temperature.

9. The method of claim 7, further comprising the step of applying a rust inhibitor to said track shoe.

10. The method of claim 7, further comprising the step of painting said track shoe.

11. The method of claim 7, wherein said quenching is accomplished by at least partially submerging said track shoe in a molten salt bath.

* * * * *